US008074516B2

(12) United States Patent
Facciano et al.

(10) Patent No.: US 8,074,516 B2
(45) Date of Patent: Dec. 13, 2011

(54) METHODS AND APPARATUS FOR NON-AXISYMMETRIC RADOME

(75) Inventors: Andrew B. Facciano, Oro Valley, AZ (US); Brian J. Gowler, Tucson, AZ (US); James L. Kinzie, Oro Valley, AZ (US); Quenten E. Duden, Tucson, AZ (US); Blake R. Tennison, Sahvarita, AZ (US); Adam P. Cherrill, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 282 days.

(21) Appl. No.: 12/394,250

(22) Filed: Feb. 27, 2009

(65) Prior Publication Data

US 2009/0320589 A1 Dec. 31, 2009

Related U.S. Application Data

(60) Provisional application No. 61/076,069, filed on Jun. 26, 2008.

(51) Int. Cl.
*G01D 11/24* (2006.01)

(52) U.S. Cl. ..... 73/431

(58) Field of Classification Search ..... 73/431; 343/872

See application file for complete search history.

(56) References Cited

U.S. PATENT DOCUMENTS

| | | | | |
|---|---|---|---|---|
| 5,483,894 | A | 1/1996 | Facciano et al. | |
| 6,483,323 | B1 * | 11/2002 | Bai et al. | 324/675 |
| 7,392,963 | B1 * | 7/2008 | Leek et al. | 244/3.13 |
| 2002/0050559 | A1 * | 5/2002 | Mangoubi | 250/216 |
| 2007/0228211 | A1 * | 10/2007 | Facciano et al. | 244/3.19 |
| 2009/0325443 | A1 * | 12/2009 | Blackden et al. | 442/203 |

FOREIGN PATENT DOCUMENTS

| | | | |
|---|---|---|---|
| FR | 2890643 | A | 3/2007 |
| JP | 04060398 | A * | 2/1992 |

* cited by examiner

*Primary Examiner* — Lisa Caputo
*Assistant Examiner* — Jamel Williams
(74) *Attorney, Agent, or Firm* — The Noblitt Group, PLLC

(57) ABSTRACT

Methods and apparatus for non-axisymmetric radome according to various aspects of the present invention include a non-symmetric housing for a forward portion of a projectile. Multiple sensors may be positioned in an off-axis configuration within the non-symmetric housing reducing the possibility of one sensor interfering with the operation of another sensor. The non-symmetric housing may also be configured with a strengthening member suitably adapted to provide additional resistance to bending moments caused by external loading along a surface of the non-symmetric housing.

18 Claims, 7 Drawing Sheets

METHODS AND APPARATUS FOR NON-AXISYMMETRIC RADOME

CROSS-REFERENCES TO RELATED APPLICATIONS

This application claims the benefit of U.S. Provisional Patent Application No. 61/076,069, filed Jun. 26, 2008, and incorporates the disclosure in its entirety by reference.

BACKGROUND OF INVENTION

Projectiles such as missiles, bombs, interceptors, and similar targeted airframes utilize sensors for guidance. Typically one or more sensors are located in a forward section, or nose, of the projectile often necessitating the use of a radome assembly to provide the sensor a path to obtain data pertaining to flight characteristics, position, or target location. Ceramic radomes are commonly used but have several shortcomings.

Typical ceramics provide poor erosion resistance and are subject to damage from rain and particulates. This damage may "blind" the projectile during flight and/or cause premature warhead ignition. Increases in projectile velocity result in increased radome surface temperatures and it is common to use a symmetric ceramic radome incorporating various structural elements such as, ablative thermal protective overlaps, structural cutouts, fasteners, doublers, and the like. Each of these elements may involve significant labor to construct and implement, additional weight, and increased complexity. Moreover, conventional radomes utilizing additional structural elements may provide a potential leak path requiring in the use of multiple gaskets and seals to isolate internal components from the environment.

SUMMARY OF THE INVENTION

Methods and apparatus for non-axisymmetric radome according to various aspects of the present invention include a non-symmetric housing for a forward portion of a projectile. Multiple sensors may be positioned in an off-axis configuration within the non-symmetric housing reducing the possibility of one sensor interfering with the operation of another sensor. The non-symmetric housing may also be configured with a strengthening member suitably adapted to provide additional resistance to bending moments caused by external loading along a surface of the non-symmetric housing.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention may be described herein in terms of functional block components and various processing steps. Such functional blocks may be realized by any number of hardware or software components configured to perform the specified functions and achieve the various results. For example, the present invention may employ various housings, connectors, sensors, and the like, which may carry out a variety of functions. In addition, the present invention may be practiced in conjunction with any number of projectiles such as guided missiles or supersonic interceptors, and the system described is merely one exemplary application for the invention. Further, the present invention may employ any number of conventional techniques for launching and guiding projectiles, sensing environmental conditions, and the like.

Figure 1:
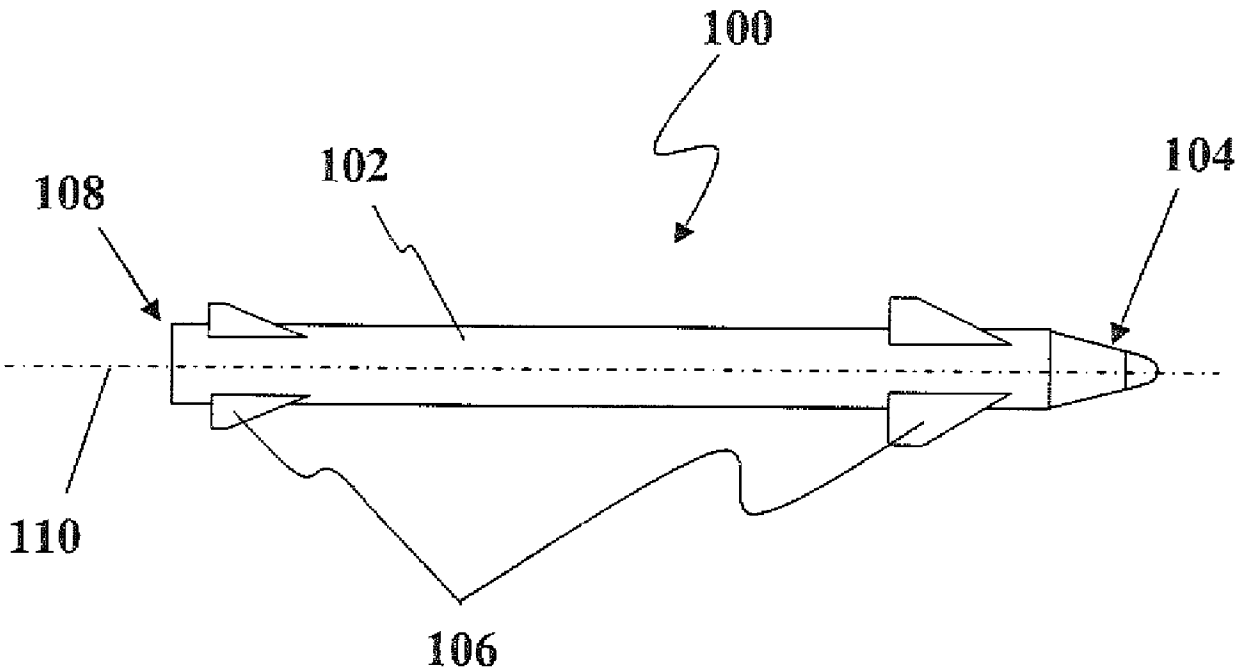
(Prior Art) FIGURE 1
FIG. 1 representatively illustrates a prior art projectile.
Figure 2:
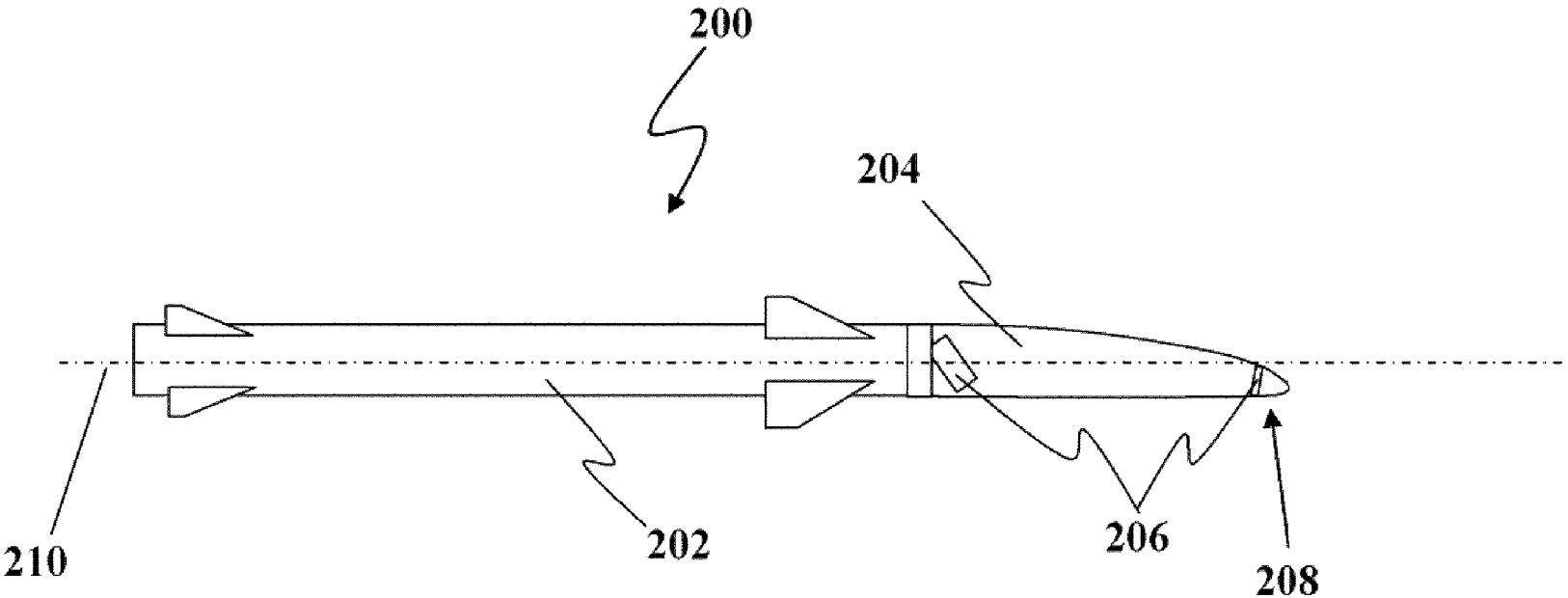
FIG. 2 representatively illustrates a projectile fitted with a non-axisymmetric radome in accordance with an exemplary embodiment of the present invention.

Various representative implementations of the present invention may be applied to any system for guiding projectiles. Certain representative implementations may include, for example, a supersonic guided interceptor. Referring to FIG. 1, a prior art projectile 100 may comprise a body 102, an axisymmetric forebody 104, flight control surfaces 106, and a propulsion system 108. The forebody 104 may be configured to be symmetric about a longitudinal axis 110 of the projectile with the intent of equalizing stresses across the entire surface of the body 102. Equalized stress loading on the projectile may be desirable in part due to aerodynamic loading on the projectile 100 during flight, to account for a spinning motion of the projectile 100 during flight, manufacturing concerns, or to accommodate the launch vehicle. Referring now to FIG. 2, methods and apparatus for non-axisymmetric radome according to various aspects of the present invention may operate in conjunction with a projectile 200 and a non-axisymmetric forebody 204 which is not symmetric about a longitudinal axis 210 of the projectile and is configured to house or substantially cover one or more sensors 206. The forebody 204 may also comprise a nosecone 208 or be suitably configured for attachment to a nosecone 208.

The projectile 200 comprises a moving system, for example to deliver a payload such as a warhead. The projectile 200 may comprise any system that is configured to travel, either by an on-board propulsion system or ballistically, such as a guided missile, a rocket, a bomb, a hit-to-kill interceptor, a kinetic energy penetrator, or a countermeasure. For example, the projectile 200 may comprise a multi-stage propulsion system comprising a booster stage and a secondary stage rocket motor enabling an intercontinental range. Alternatively, the projectile 200 may be configured with an air breathing engine adapted for a range of less than 200 miles.

The projectile 200 may also be suitably configured to travel at any appropriate speed or altitude. For example, the projectile 200 may be adapted to travel at or near transonic speeds. In another embodiment, the projectile 200 may travel at supersonic speeds. In a third embodiment, the projectile 200 may be suitably configured for at least stratospheric flight.

The projectile 200 may also comprise additional elements such as a set of extendable tail fins or other control surfaces to provide stabilization and/or control the direction of flight.

The sensors 206 provide information relating to the surrounding environment to another system, such as a guidance system. The sensors 206 may comprise any suitable system that is responsive to radio frequency (RF) or light waves in the visible and/or non-visible spectra such as electromagnetic radiation detecting systems, laser guided seekers, digital camera lenses, optical positioning sensors, photodiode detectors, focal plane arrays, photodiodes, and the like. For example, referring to FIG. 3 of one embodiment, a first sensor 304 may comprise a side looking RF seeker and a second sensor 306 may comprise a forward looking infrared seeker.

The non-axisymmetric forebody 204 at least partially encloses a portion of internal elements located in a forward section of the projectile 200 such as a warhead, a fuze, a guidance system, a control system, or sensing equipment. The non-axisymmetric forebody 204 may comprise any suitable system configured to house or cover the elements such as an aerodynamic housing. The non-axisymmetric forebody 204 may also act as a protective covering and/or shield to the internal elements. For example, the non-axisymmetric forebody 204 may be suitably adapted to provide protection against particulate matter that may strike the projectile 200 during flight or the non-axisymmetric forebody 204 may protect against thermal loads which could damage internal elements or degrade the performance of the sensors 206. The non-axisymmetric forebody 204 may also be used to protect, shield, or insulate internal elements from stray frequencies, waves, or other interference such as RF radiation and electromagnetic interference.

Figure 3:
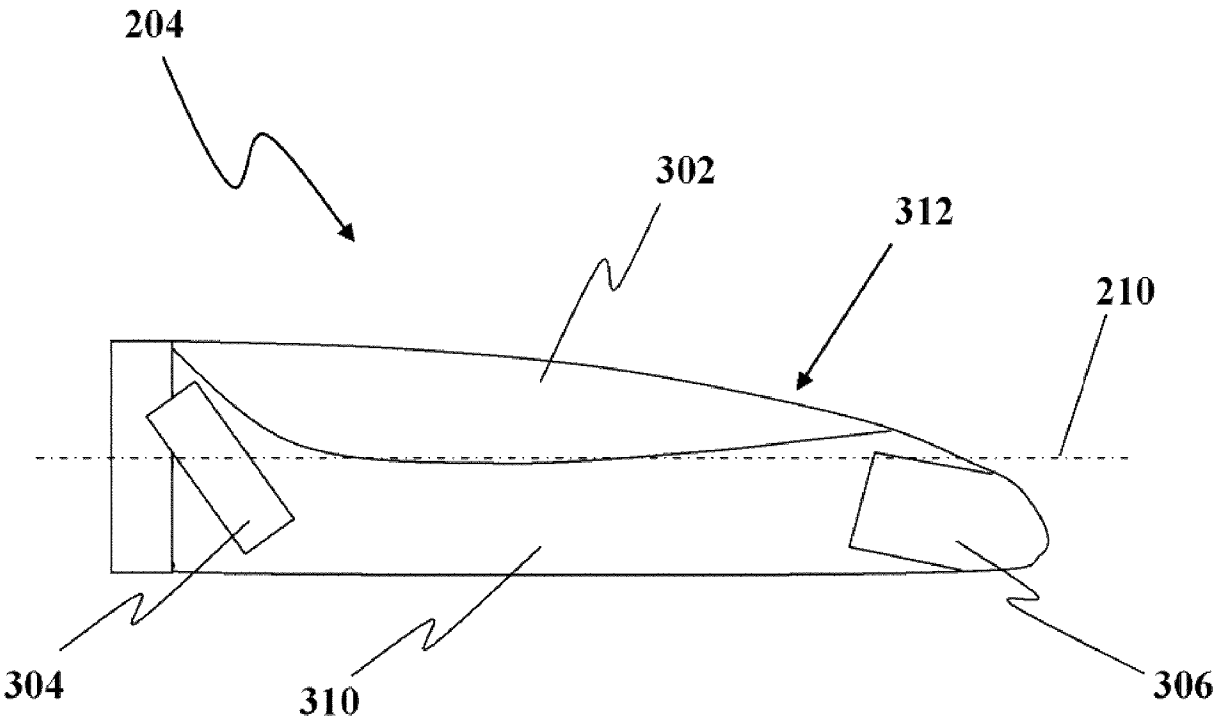
FIG. 3 representatively illustrates a non-axisymmetric forebody.

The non-axisymmetric forebody 204 may be configured in any suitable size or dimension. The inner volume of the non-axisymmetric forebody 204 may vary depending on the type of projectile 200 the non-axisymmetric forebody 204 is connected to or on the number of elements located within the non-axisymmetric forebody 204. Referring to FIGS. 2 and 3, in the present embodiment, the non-axisymmetric forebody 204 comprises a non-axisymmetric structure suitably configured to house multiple sensors 206 in such a manner as to prevent the sensors 304, 306 from significantly interfering with the operation of each other. For example, the sensors 304, 306 may be positioned non-symmetrically about a longitudinal axis 210. The offset configuration of the sensors 304, 306 may allow a forward looking sensor 306 to be positioned in the nose section of the non-axisymmetric forebody 204 and a side looking sensor 304 to be positioned further aft in the non-axisymmetric forebody 204 such that each sensor operates with a reduced likelihood of affecting the performance of the other sensor.

The location of the sensors 304, 306 and the shape of the non-axisymmetric forebody 204 may result in greater moment loading for the non-axisymmetric forebody 204 than for the axisymmetric forebody 102. The greater loading on the non-axisymmetric forebody 204 may be due at least in part to pressure forces exerted on a curved upper portion 312 of the non-axisymmetric forebody 204 which do not exist on the traditional axisymmetric forebody 102. The pressure forces may be exerted along the curved upper portion 312 in one or more phases of flight such as during launch and/or during in-flight maneuvers. For example, an interceptor traveling at greater than supersonic velocity may experience a dramatic increase in pressure loads along the curved upper portion 312 during maneuvers associated with terminal phase interception of a target due at least in part to the mass of each sensor and its respective location within the non-axisymmetric forebody 204 and the addition of a payload to a forward portion of the non-axisymmetric forebody 204 or nosecone 208.

Additionally, the alignment of the forward sensor 306 and/or payload in relation to the projectile body 202 and the longitudinal axis 210 may increase the likelihood of dynamic jitter and smearing on the forward sensor 306 reducing the effectiveness of the projectile 200. To counter this potential, the non-axisymmetric forebody 204 may require additional structural stiffening and/or increased resistance to bending moments. For example, referring to FIG. 3, the non-axisymmetric forebody 204 may comprise a strengthening member 310 suitably configured to resist the additional forces and moments exerted on the non-axisymmetric forebody 204.

The non-axisymmetric forebody 204 may comprise any suitable material such as metal, plastic, elastomer, composite, or any suitable combination thereof. The non-axisymmetric forebody 204 may also comprise a combination of different materials which may be coupled together and adapted to perform different functions. For example, in one embodiment, the non-axisymmetric forebody 204 may comprise a window 302 section bonded to the strengthening member 310 section forming a one-piece structure. A single seal located at the transition between the non-axisymmetric forebody 204 and the body of the projectile 200 may be used to isolate internal components from the environment.

The window 302 acts as a transparent surface disposed between at least one of the sensors 304, 306 and the exterior of the projectile 200. The window 302 may comprise any system that is configured to be substantially transparent to a passing energy wave over a particular frequency or range of frequencies. The window 302 may be comprised from a variety of RF transparent materials such as composites or ceramics depending upon a particular application. For example, in one embodiment the window 302 may be comprised of an organic resin such as Bismaleimide, Cynate Ester, Polyimide, or Phthalonitrile.

During flight of the projectile 200, operating temperatures on the surface of the non-axisymmetric forebody 204 may exceed 400 degrees Fahrenheit creating ablation concerns. Ablation resulting from increased surface temperatures on the window 302 or across the non-axisymmetric forebody 204 may affect the reliability of the sensors 304, 306. The window 302 may therefore also be configured to incorporate a thermal protection system (TPS). The TPS may comprise any suitable method for increasing the heat tolerance of the window 302 or for dissipating heat from the window 302. For example, in one embodiment, a glass or quartz reinforced organic composite may be used when the window 302 is subjected to high thermal shock loading. In another embodiment, the window 302 may be subject to longer term high temperature thermal soaks of approximately 2,000 degrees Fahrenheit during supersonic or transonic flight and suitable high temperature materials such as polymeric silicone may be used.

The window 302 may be formed by any suitable fabrication method such as resin transfer molding, filament winding, or similar composite lay up processes. The window may also be formed to at least substantially create the non-axisymmetric forebody 204 shape. For example, the window 302 may comprise the final shape and size of the non-axisymmetric forebody 204 and be suitably configured to attach to the forward end of the projectile 100 and/or a nosecone 208.

Figure 4:
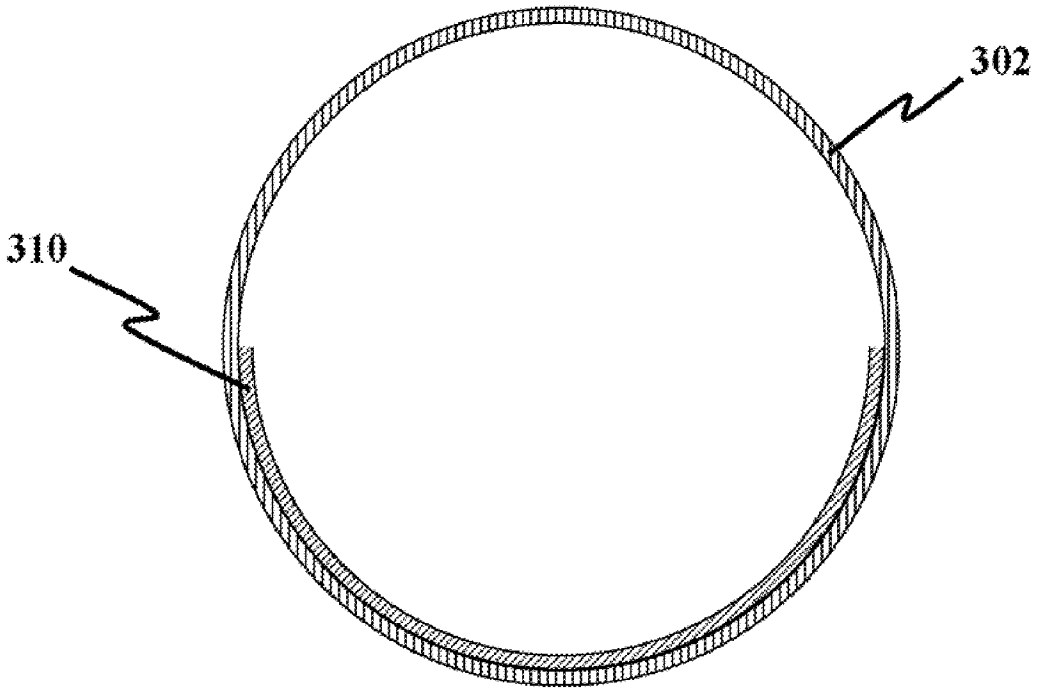
FIG. 4 representatively illustrates a cross-section of a non-axisymmetric forebody displaying the interface between a strongback and a window.

The strengthening member 310 increases the structural capabilities of the non-axisymmetric forebody 204. The strengthening member 310 may comprise any suitable system for improving structural qualities such as a beam, longitudinal stiffeners, or a fiber reinforced composite layer. For example, referring to FIG. 4, the strengthening member 310 may comprise a reinforcing strongback of composite material having graphite fiber reinforcements. The type of reinforcing fibers may also be dependent upon application or environment. In one embodiment, the composite may include multiple types of reinforcing fibers to handle both transitive event loading and constant asymmetric loading.

The strengthening member 310 may be disposed immediately adjacent to at least a portion of the window 302. For example, referring again to FIG. 4, in one embodiment, the fiber reinforced strongback may be positioned along a lower inner portion of the window 302 such that the reinforced strongback does not impede the transparent characteristics of an upper portion of the window 302. In another embodiment, the amount of the window 302 connected to the reinforced strongback may be dependent upon the type of sensor 304 used and the desired size of the transparent portion of the window 302.

Figure 5:
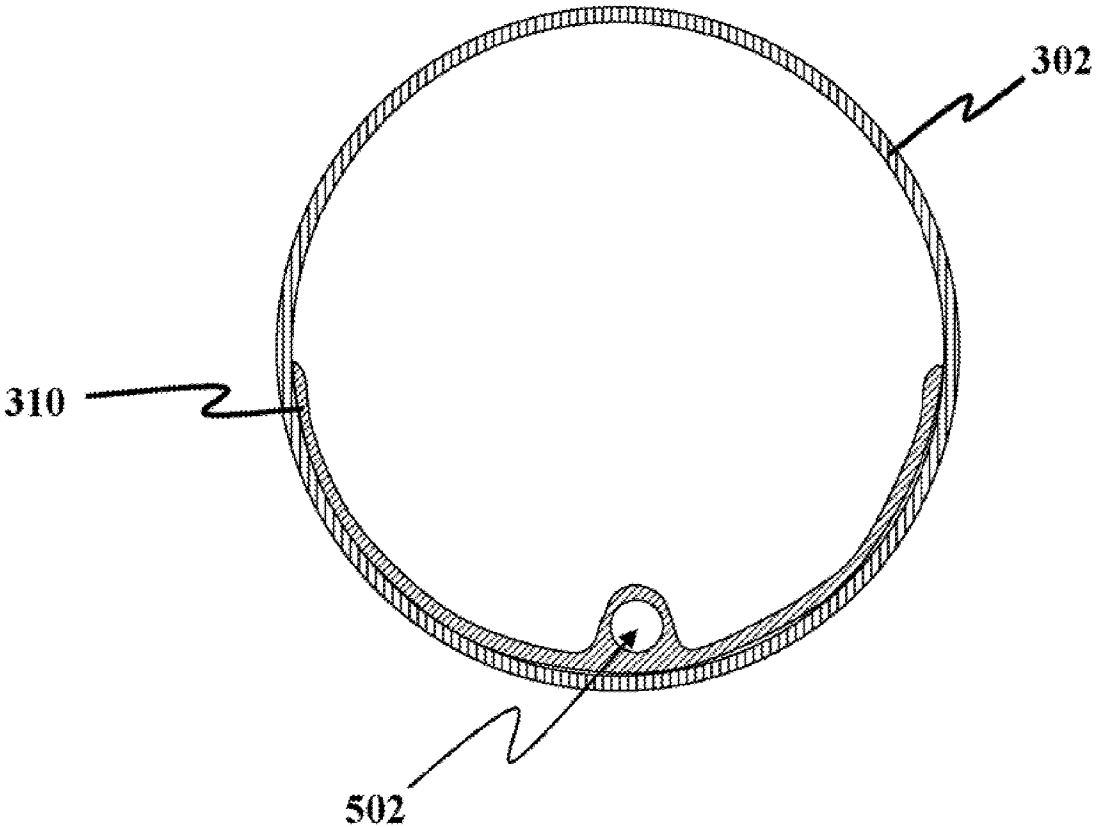
FIG. 5 representatively illustrates a channel for a wiring harness incorporated into the strongback.

The strengthening member 310 may also be configured to incorporate electrical cabling. The cabling may be used to provide power to or send and receive signals from the sensors 304, 306. Referring to FIG. 5, in one embodiment, the strengthening member 310 may comprise a tunnel 502 suitably adapted to pass-thru various wires or cables such as fiber optic, electrical, or data wires. The tunnel 502 may also be suitably adapted to increase the stiffness of the strengthening member 310. For example, the tunnel 502 may comprise a carbon or graphite reinforced tube integrated into the strengthening member 310.

In a second embodiment, the strengthening member 310 may comprise an integrated cabling system such as a length of flex cable disposed within the overall strengthening member 310 laminate. The integrated cabling system may or may not be configured to provide additional structural capabilities to the strengthening member 310.

Figure 6:
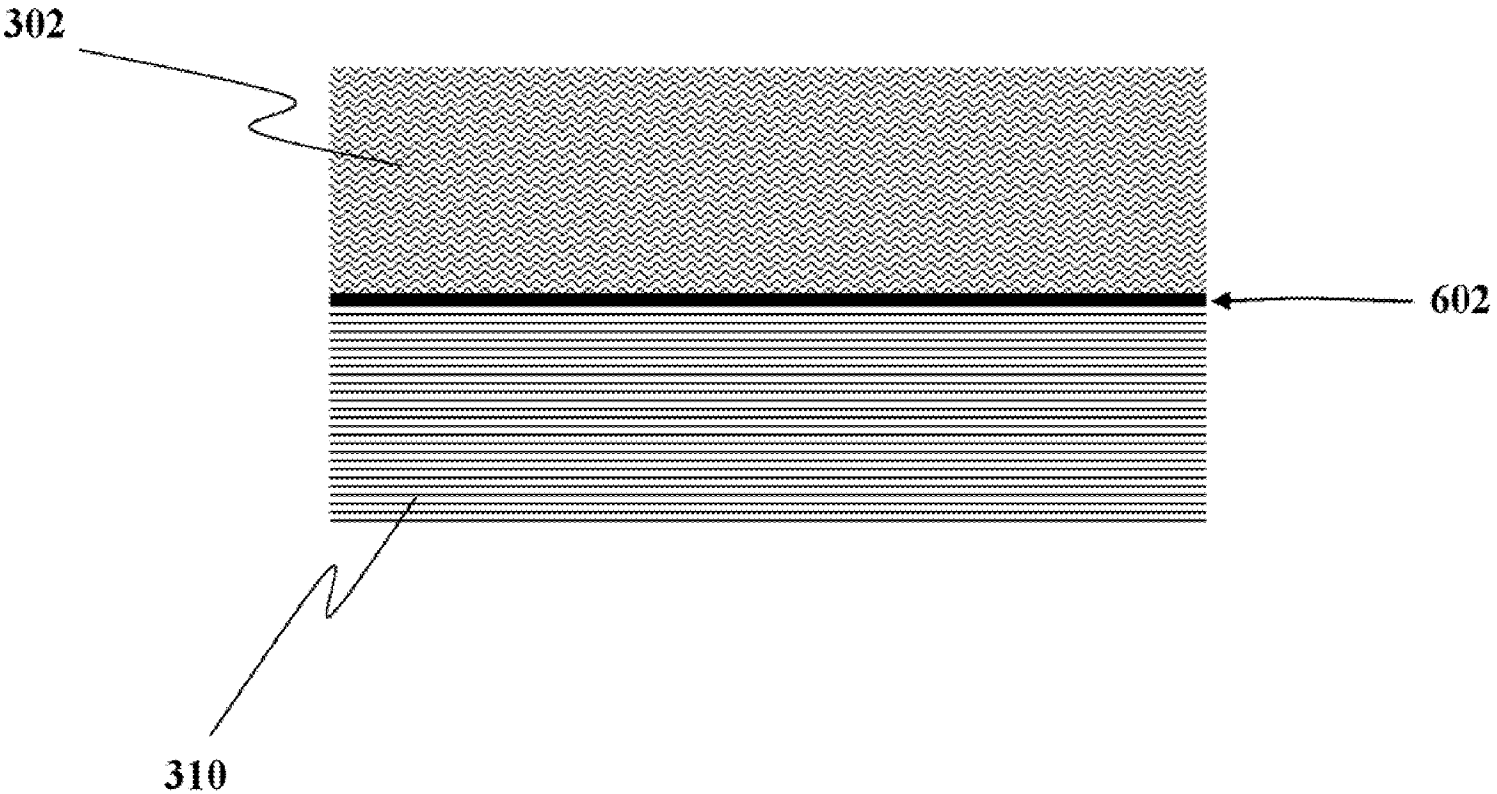
FIG. 6 representatively illustrates a prior art method of bonding multiple structures together.
Figure 7:
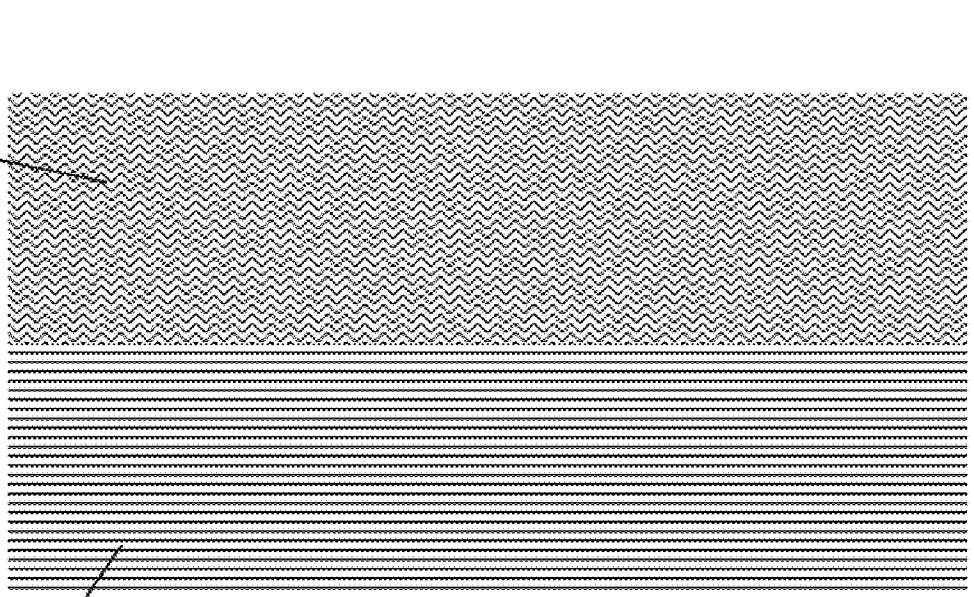
FIG. 7 representatively illustrates a hybrid method of curing multiple structures together.

The window 302 and the strengthening member 310 may be coupled together by any suitable method such as with mechanical fasteners or adhesively. For example, referring to FIG. 6, in one embodiment, the window 302 may be chemically bonded to the strengthening member 310 creating a bond line 602 between the two systems. Alternatively, the window 302 and the strengthening member 310 may be connected without mechanical fasteners such that no bond line 602 is present. Referring now to FIG. 7, the strengthening member 310 may be secondarily cured to the window 302 as a different layer of a single hybrid composite lay up. Curing the strengthening member 310 to the window 302 may help absorb tolerance mismatches between the two system and eliminates the bond line 602 increasing the overall structural effectiveness of the non-axisymmetric forebody 204.

In operation, a non-axisymmetric forebody 204 may be connected to a forward portion of a projectile 200. The non-axisymmetric forebody 204 may house or cover one or more sensors 304, 306 which may be used to guide the projectile 200 to a target. The non-symmetric design of the non-axisymmetric forebody 204 allows each sensor 304, 306 to operate in an offset configuration reducing the likelihood of operational interference between sensors 304, 306.

During flight, the non-axisymmetric forebody 204 may be subjected to increased bending loads due to unequal forces along the surface of the non-axisymmetric forebody 204. For example, if the projectile 200 has to perform a course correction at a high speed, such as at or above the transonic range, an upper surface of the non-axisymmetric forebody 204 may experience pressure loading which could significantly impact targeting performance of the projectile or damage the non-axisymmetric forebody 204.

A strengthening member 310 may be incorporated into a portion of the non-axisymmetric forebody 204 to increase structural performance. In one embodiment, the strengthening member 310 may be integrated into a lower portion of a window 302 assembly. The strengthening member 310 may be suitably adapted to provide increased stiffness against bending moments created by forces along the upper portion of the non-axisymmetric forebody 204.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. A forebody for housing multiple sensors in a projectile, comprising:

a non-axisymmetric surface configured to:

connect to a body section of the projectile to form a forward end of the projectile; and at least partially cover the multiple sensors, wherein the non-axisymmetric surface defines a window allowing the forward end of the projectile to be substantially transparent to an operating frequency of one of the multiple sensors; and a strengthening member disposed along an inner surface section of the non-axisymmetric surface, wherein the strengthening member is configured to increase a resistance of the non-axisymmetric surface to an externally applied load.

2. A projectile forebody according to claim 1, wherein a first sensor is positioned in an off axis configuration from that of a second sensor with respect to a longitudinal axis of the projectile.

3. A projectile forebody according to claim 1, wherein the non-axisymmetric surface further comprises a nosecone configured to substantially cover the second sensor.

4. A projectile forebody according to claim 3, wherein the non-axisymmetric surface further comprises a thermal protection system.

5. A projectile forebody according to claim 4, wherein the thermal protection system comprises a reinforced organic composite.

6. A projectile forebody according to claim 5, wherein the strengthening member comprises a fiber reinforced composite overlaid by and secondarily cured to the reinforced organic composite.

7. A projectile forebody according to claim 1, wherein the strengthening member is further configured to provide a path for an electrical wiring assembly.

8. A projectile forebody according to claim 1, further comprising an environmental seal disposed between the non-axisymmetric surface and the body section of the projectile, wherein the seal is configured to prevent particulates from entering an interior portion of the non-axisymmetric surface.

9. A radome assembly for a housing a first sensor and a second sensor in a projectile, comprising:

a non-axisymmetric forebody configured to:

connect to a body section of the projectile to form a forward end of the projectile; and substantially cover the first sensor, wherein the non-axisymmetric forebody comprises:

a window forming the non-axisymmetric forebody shape and adapted to be substantially transparent to an operating radio frequency of the first sensor; and a reinforcing strongback disposed along an interior surface portion of the window, wherein the reinforcing strongback is configured to increase a resistance of the window to an externally applied load; and a nosecone connected to the non-axisyimmetric forebody, wherein the nosecone is configured to at least partially cover the second sensor in an off axis configuration from that of the first sensor with respect to a longitudinal axis of the projectile.

10. A radome assembly according to claim 9, wherein the window further comprises a thermal protection system.

11. A radome assembly according to claim 10, wherein the thermal protection system comprises a reinforced organic composite.

12. A radome assembly according to claim 11, wherein the reinforcing strongback comprises a fiber reinforced composite overlaid by and secondarily cured to the reinforced organic composite.

13. A radome assembly according to claim 9, wherein the reinforcing strongback is further configured to provide a path for an electrical wiring assembly.

14. A radome assembly according to claim 9, wherein the reinforcing strongback further comprises a layer configured to provide electromagnetic interference shielding.

15. A radome assembly according to claim 9, further comprising an environmental seal disposed between the non-axisymmetric forebody and the body section of the projectile, wherein the seal is configured to prevent particulates from entering an interior portion of the non-axisymmetric forebody and nosecone.

16. A method for connecting multiple sensors to a projectile comprising:

forming a window adapted to be substantially transparent to an operating radio frequency of at least one of the multiple sensors, wherein the window defines a non-axisymmetric forebody and comprises a reinforcing strongback disposed along an inner surface portion of the non-axisymmetric forebody, wherein the reinforcing strongback is configured to increase a resistance of the window to an externally applied load on the non-axisymmetric forebody;

connecting the non-axisymmetric forebody to a body section of the projectile to form a forward end of the projectile; and disposing at least two sensors within the non-axisymmetric forebody, wherein the at least two sensors are positioned in an off axis configuration with respect to the longitudinal axis of the projectile.

17. A method for connecting multiple sensors to a projectile according to claim 16, further comprising routing an electrical wiring assembly through the reinforcing strongback.

18. A method for connecting multiple sensors to a projectile according to claim 16, wherein the reinforcing strongback comprises a fiber reinforced composite overlaid by and secondarily cured to the window.

* * * * *